United States Patent [19]

Bertoldi

[11] 4,018,068

[45] Apr. 19, 1977

[54] APPARATUS HAVING OSCILLATING PERMEABLE WALLS FOR FABRIC TREATMENT

[76] Inventor: Attilio Bertoldi, Via Luzzago 27, Manerbio (Brescia), Italy

[22] Filed: Sept. 3, 1975

[21] Appl. No.: 609,922

[30] Foreign Application Priority Data

Sept. 12, 1974 Italy ..... 27218/74
June 10, 1975 Italy ..... 24180/75

[52] U.S. Cl. ..... 68/175
[51] Int. Cl.[2] ..... D06B 3/20
[58] Field of Search ..... 68/355, 38, 175, 181 R, 68/184, 190; 134/122 R, 122 P

[56] References Cited

UNITED STATES PATENTS

| | | | |
|---|---|---|---|
| 3,044,286 | 7/1962 | Wilde et al. | 68/38 X |
| 3,540,242 | 11/1970 | Stearns | 68/175 |
| 3,595,159 | 7/1971 | Bull | 134/122 P |
| 3,717,160 | 2/1973 | Tobias | 68/175 X |

*Primary Examiner*—Philip R. Coe
*Attorney, Agent, or Firm*—Steinberg & Blake

[57] ABSTRACT

An apparatus is disclosed for the treatment of fabrics, wherein the fabric is at least transversely spread out through at least one channel filled with liquid and having at least one of its walls subjected to an oscillatory movement, wherein both of the channel walls are permeable and transversely oscillated and provided with liquid passages directing the liquid against the fabric with a component in the feeding direction of the latter.

8 Claims, 4 Drawing Figures

APPARATUS HAVING OSCILLATING PERMEABLE WALLS FOR FABRIC TREATMENT

This invention relates to an apparatus for treating fabrics by means of liquids. As herein used, the term "treatment" is intended to mean fulling, dyeing, washing and similar operations which are carried out on the fabric by means of a liquid agent.

More particularly, an apparatus according to the invention is designed for washing cotton fabrics to remove vegetable parts, such as shells, confined with the fabric, printed cotton fabrics to remove undesired materials (such as adhesives), and wool or mixed-wool fabrics to confer thereto the required softness, during operation, ensuing from a fulling process which, by a machine according to the invention, is concomitant to washing.

Still more particularly, a machine according to the invention is of a type where the fabric, at least transversely stretched out, is moved through channels having at least one of the walls thereof rockingly moving.

Apparatus of the above cited character are known. U.S. Pat. Nos. 2,904,981 and 3,183,690 disclose an apparatus wherein a fabric, spread out in width dimension, vertically travels through a first channel containing the processing liquid and, after turning through 180°, a second channel which is hydraulically connected with said first channel. The two channels are separated by a stationary hollow partition, while the other walls made of rubber or other flexible material are subjected to substantially undulatory vibration. In said U.S. Pat. No. 2,904,981 there is also disclosed a variation, wherein instead of being made of rubber, the walls are rigid and vibrations are provided by electric transducers rather than by crank mechanisms.

The disadvantages of such apparatus reside in the complex construction thereof, and the incapability of the processing liquid to violently pass through the fabric to be treated with resulting absence of water compression, and therefore to exert a vigorous washing action along with a mechanical action which, particularly in wool or mixed-wool fabrics, serves to soften and then full the fabric.

British Pat. No. 831,245 and French Pat. No. 1,093,249 disclose apparatus wherein the partition between immediately successive channels is configurated as a diamond and subjected to vibration in a longitudinal direction. In these approaches, one of the drawbacks is the incapability of simultaneously washing and fulling wool or mixed-wool fabrics, since the motions of the processing liquid, due to the particular configuration of the oscillating partition, tend to maintain the fabric separated from the apices of the diamonds with a resulting lack of slipping thereagainst. Moreover, as the fabric is maintained under tension, the fabric cannot contract in the longitudinal direction, which would hinder or prevent the fulling operation. Finally, there is no component of the liquid constantly in its feeding direction, thus causing the fabric to be tensioned, that is stretched, in longitudinal direction to the detriment of fulling.

French Pat. No. 1,230,246 contemplates that the partition between consecutive channels can vertically oscillate and the partition surface and stationary wall of the channel are of sawtooth configuration. Also in this approach, the processing liquid is not always circulating in the fabric moving direction, thus not promoting the forward movement thereof. Furthermore, since no passages are provided in the walls defining each channel, no slipping of the fabric occurs against the apices of the serrations.

French Pat. No. 1,410,143 discloses a device for washing fabrics in width dimension, in which the fabric passes to channels, the undulated walls of which undergo offset undulatory movements in a longitudinal direction. Also in this case, there is no component of the liquid promoting the fabric feeding, no fabric slipping against the apices of the undulations, and the processing liquid is not violently forced through the fabric.

French Pat. No. 2,039,747 discloses an apparatus having an oscillating semicircular channel with permeable walls, in which the fabric folds up. Transverse tabs are secured on the outside of the channel and, as the latter oscillates, cooperate with fixed tabs to cause a radially directed motions of the processing liquid. Also in this approach, water motions will not promote fabric feeding. The fabric is folded up and hence water motion transversely of the channel is intensely resisted. No fulling effect is achieved due to absence of mechanical slipping action. Thus, such a machine can be used only for washing.

It is the primary object of the present invention to provide a multiuse machine for rapidly and efficiently wet treating a fabric spread out in width dimension, that is unfolded, particularly for cotton, wool and mixed-wool fabrics.

Other objects and features of the invention will become more apparent from the following detailed description of the apparatus according to the invention, that is a type of apparatus in which the fabric, at least transversely spread out, is carried through at least one channel having at least one of its walls subjected to an oscillatory movement, which apparatus is essentially characterized in that the channel walls are permeable, subjected to transverse oscillations, and provided with liquid passages directing the liquid towards the fabric with a component in the feeding direction of the fabric.

According to an important feature of the invention, the oscillating walls of the channel comprise passages of decreasing section towards the fabric (to increase the speed of the outgoing liquid falling on and passing through the fabric) and directed towards the fabric with a component in the feeding direction of the latter.

As a result of permeability of the walls, the processing liquid passes through both the walls and the fabric and the latter is alternately urged in contact with the walls which, to exert a mechanical action on the fabric, are provided with apices on which the fabric slips.

The invention will be better understood from the following detailed description, given by mere way of unrestrictive example, of embodiments thereof, shown in the accompanying drawings, in which.

Figure 1:
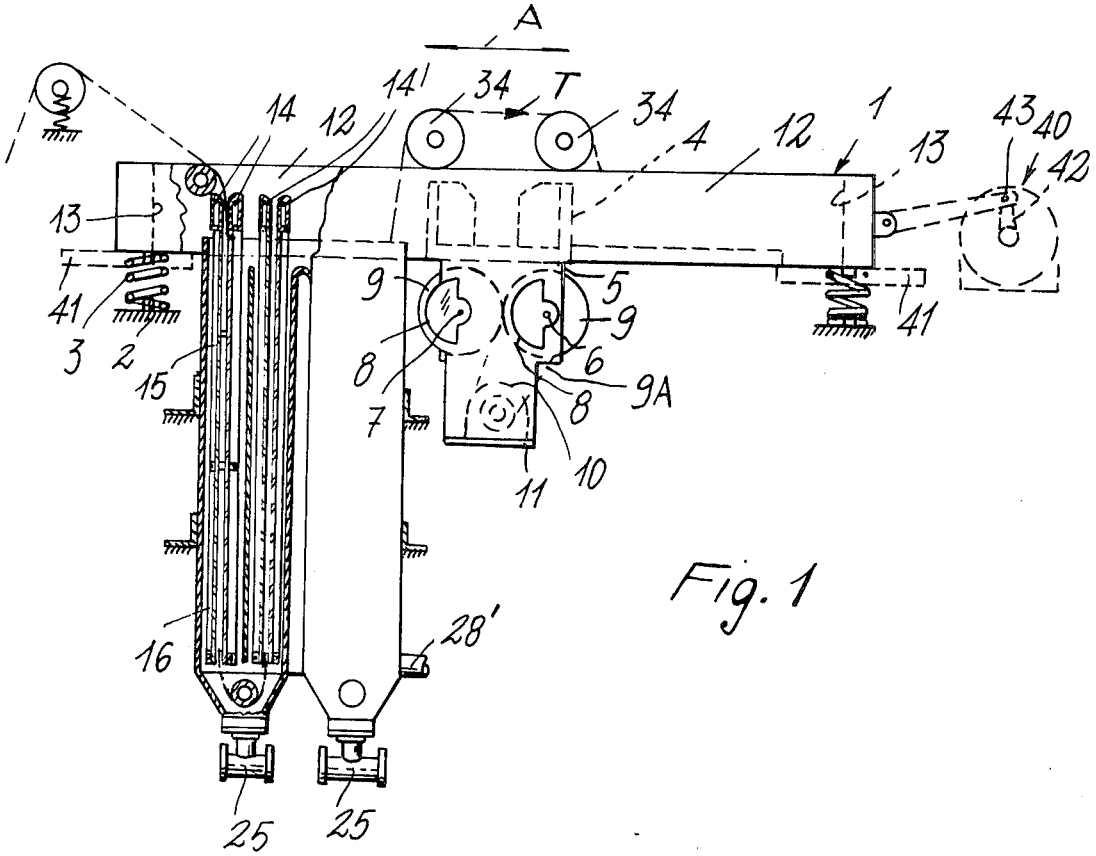
FIG. 1 is a side elevational view showing the apparatus according to the invention, some parts being cut away.
Figure 2:
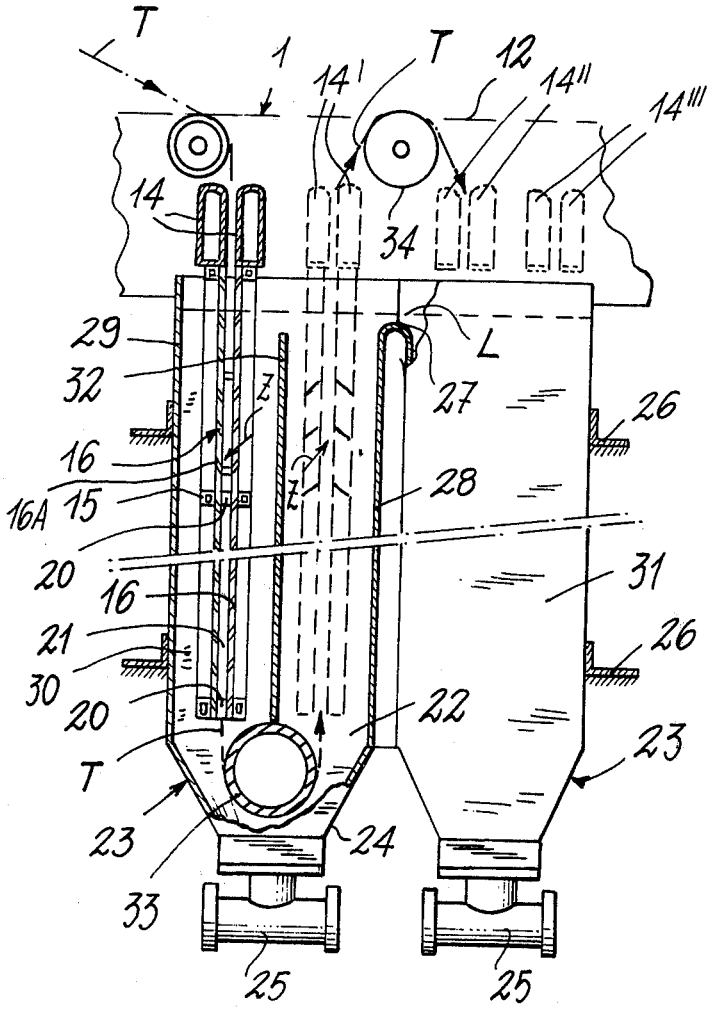
FIG. 2 is an enlarged, partially sectional view, showing a detail.

Referring to FIGS. 1 and 2, reference numeral 1 designates a rectangular metal frame comprising axially hollow sections welded to one another at the four corners or edges. This carrier frame rests on any fixed bearing surfaces 2 by means of helical springs 3. Midway of its length, said frame has a cross piece 4, to which two parallel, spaced apart and downward shoulders 5 are connected, the shoulders carrying two parallel shafts 6 and 7. Eccentric masses 8 are mounted to the ends of said shafts, which ends extend beyond shoulders 5. Intermeshing gear wheels 9 are mounted on the shafts between the shoulders. A pulley is mounted on one of said shafts, namely shaft 6, and is rotatably driven by beltings 9A operated by an electric motor 10 carried by a cross piece 11 which is secured to said shoulders 5. These eccentric masses are keyed to the respective shafts to provide vibrations or oscillations in a horizontal direction.

When motor 10 is energized, frame 1 and the assembly connected thereto will thus oscillate in horizontal direction A (see FIG. 1). Pairs of tubular sections 14, 14', etc., are secured between the two longitudinal sides 12 of frame 1, parallel to cross piece 4 and cross sides 13 of the frame. Each of the sections have secured thereto in any known manner a lattice frame 15, made of sections, preferably tubular sections, this lattice frame 15 being vertically downwardly directed, having secured to one of its sides a permeable wall 16 formed by sloping rods 16A, as clearly shown in FIG. 2, so that as the processing liquid oscillates in the direction shown by arrow A, it is forced against the fabric through the spaces between the rods 16A of either wall 16, applying and thus causing the fabric to graze or slip against the other wall, through which the liquid also passes due to vacuum or depression developing therebehind. The sloping of the rods is such that the outgoing liquid jets have a component in the movement direction of the fabric to avoid tractions which would prevent any fulling action.

In each of the pairs, frames 15 are interconnected at the lower ends and at discrete locations, such as 20. Channels 21, in a number as supporting cross pieces 14, 14', 14'', etc., take part in the oscillation of frame 1, and fabric 4 passes through each of said channels in a direction opposite to the travel direction in the adjoining channels.

Each pair of walls 16 defining a channel 21 will oscillate in an associated stationary chamber 22, for example filled up by processing liquid to level L. Chambers 22 are contained in pairs within metal basins 23 having a sloping bottom 24 with a three-way bottom valve 25. As schematically shown by fastening angle bars 26, said basins are stationary and can be interconnected through overflow 27, and the two or more basins on one side of the vibrator unit can be connected to the basins on the other side by pipings, such as (28' FIG. 1).

Each of the basins comprise two major walls 28, 29 and two minor walls 30, 31. An intermediate vertical partition 32 parallel to walls 28, 29 divides the interior of each basin into two chambers 22 intercommunicating under and possibly over partition 32.

In order to shift fabric T from one channel 21 to another channel 21 of the same basin, on the bottom of the latter there is provided a cylinder 33 secured to the minor walls 30, 31, and to guide the fabric from one basin 23 to another basin 23 cylinders 34 are carried by oscillating frame 1.

With the machine at a halt and without liquid, fabric T is threaded into the various channels. The operation is facilitated by sewing to the front end of the fabric a metal rod provided with a number of eyelets for engagement by a rod fitted with hooks and manually operated by the operator. At the end of this operation, the processing liquid is introduced from the bottom valves 25, the unidirectional eccentric mass vibrator is operated, and at the same time the fabric is fed by passing between two cylinders or rollers, not shown, which are pressed against each other, and one of which is powered.

At least transversely spread out, the fabric moves along channels 21. Such a movement is facilitated and possibly can be promoted by the liquid jets Z, to which the configuration of rods 16A imposes a direction having a component in the direction of movement.

Due to transverse oscillation of the channels, in the stationary chambers the fabric is passed through by the liquid and struck by the walls comprising said rods 16A, thereby undergoing a highly efficient treatment which is repeated in each of the channels from the inlet to the outlet of the apparatus.

Due to the provision of the above described hydraulic connections, the processing liquid can be supplied to the most downstream basin of the apparatus through the associated valve 25 and the exhausted liquid can be discharged through the first valve 25, that is the most upstream valve, thus providing a substantially countercurrent treatment of the fabric.

In lieu of the vibrator, use can be made of a connecting rod-crank or cam mechanism 40 (operated by a motor or geared motor) to impart oscillatory motion to frame 1; in this case, the frame will be carried on stationary sliding guides 41, springs 3 obviously being omitted.

This approach has the advantage of regulating the number of sheddings per time unit by acting on the speed of crank 42 and the frame excursion or travel, changing the radial position of pin 43.

In a variation, to avoid an undue oscillation of the free end of the channels, with a resulting high stress of mechanical nature, it is provided that a second frame, arranged at some distance from said first frame 1, will interconnect the various channels with longitudinal sides guided in the basin walls by bush-bearing and stuffing boxes. This approach applies to the connecting rod-crank or cam type of operation.

Figure 3:
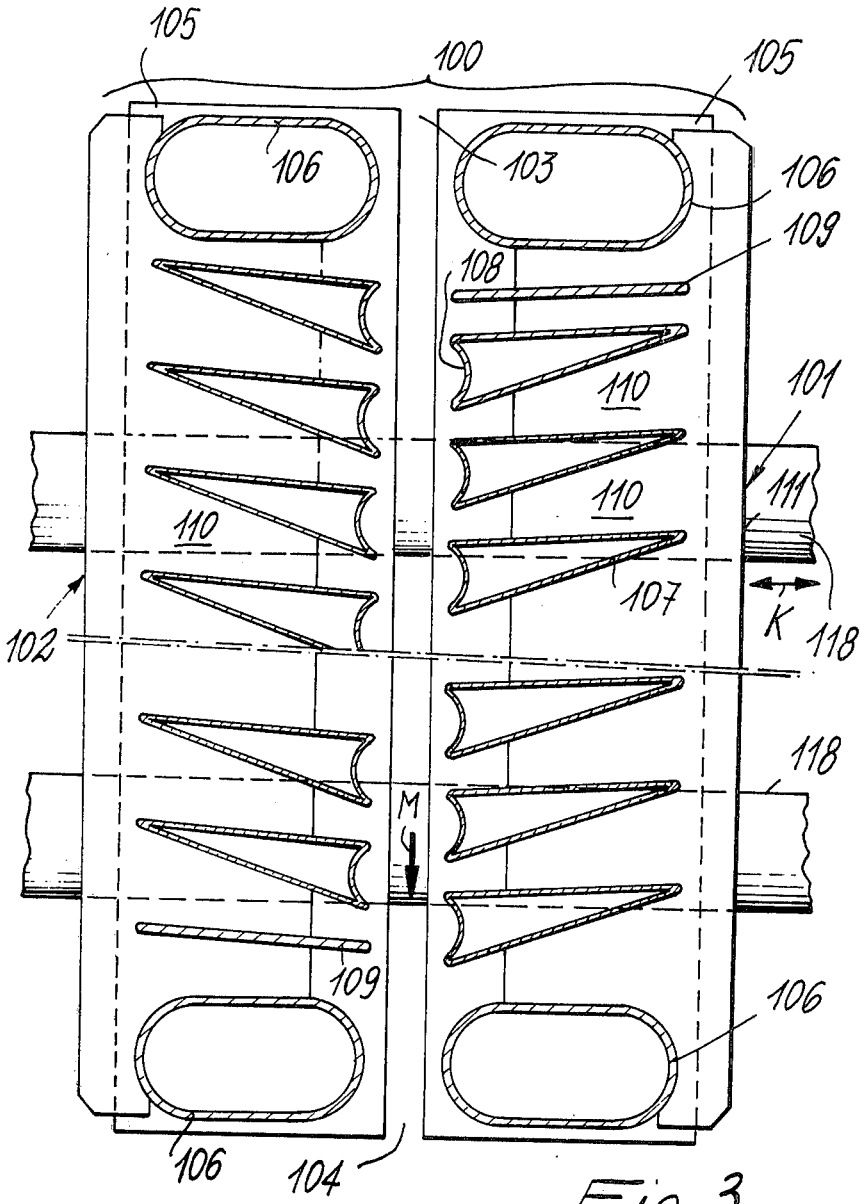
FIG. 3 is a cross-sectional view showing the permeable walls of a channel according to a preferred embodiment of the invention.

Referring to FIG. 3, there is shown a vertical sectional view of an oscillating channel, designated as a whole at 100. Channel 100 includes a pair of permeable walls 101, 102 defining a passage 103 along which fabric 104 (shown in dotted lines in FIG. 4) is moved.

Each of the walls comprise two end shoulders 105 formed by tubular sections of rectangular cross-section, having secured thereto the ends of two tubular sections of oblong cross-section with two arcuate sides 106. Between said two shoulders 105 there is also secured an intermediate series of tubular sections substantially of triangular cross-section 107 having the concave minor base 108 facing passage 103 and a flat plate or blade 109 slightly inclined to the horizontal.

Triangular sections 107 define therebetween conduits 110 of a decreasing section towards passage 103, so that, by imparting an oscillating or alternate movement to channel 100 in the direction shown by arrows K, the liquid directed to passage 103 will assume an increasing speed and a direction having a component in the feeding direction of fabric 104 (arrow M).

The connection angles between the concave base 108 and the other two sides of the triangle are rounded to avoid a sharp contact with the fabric, which could become damaged.

According to an important aspect of the invention, the outlets of passage 110 of one of the permeable walls face the concave bases 108 of the opposing wall, so that the liquid jet emerging from the former will partly fall on the latter, and partly reach the empty space of the opposing wall.

Spacing plates 111 having notches corresponding to elements 106, 107 and 109 are secured to one or more locations of each permeable wall.

To the external side of each of shoulders 105, there are secured two shafts 118 which, as more apparent hereinafter, carry the various channels 100 and are effective to impart thereto a reciprocating or to-and-fro motion.

Figure 4:
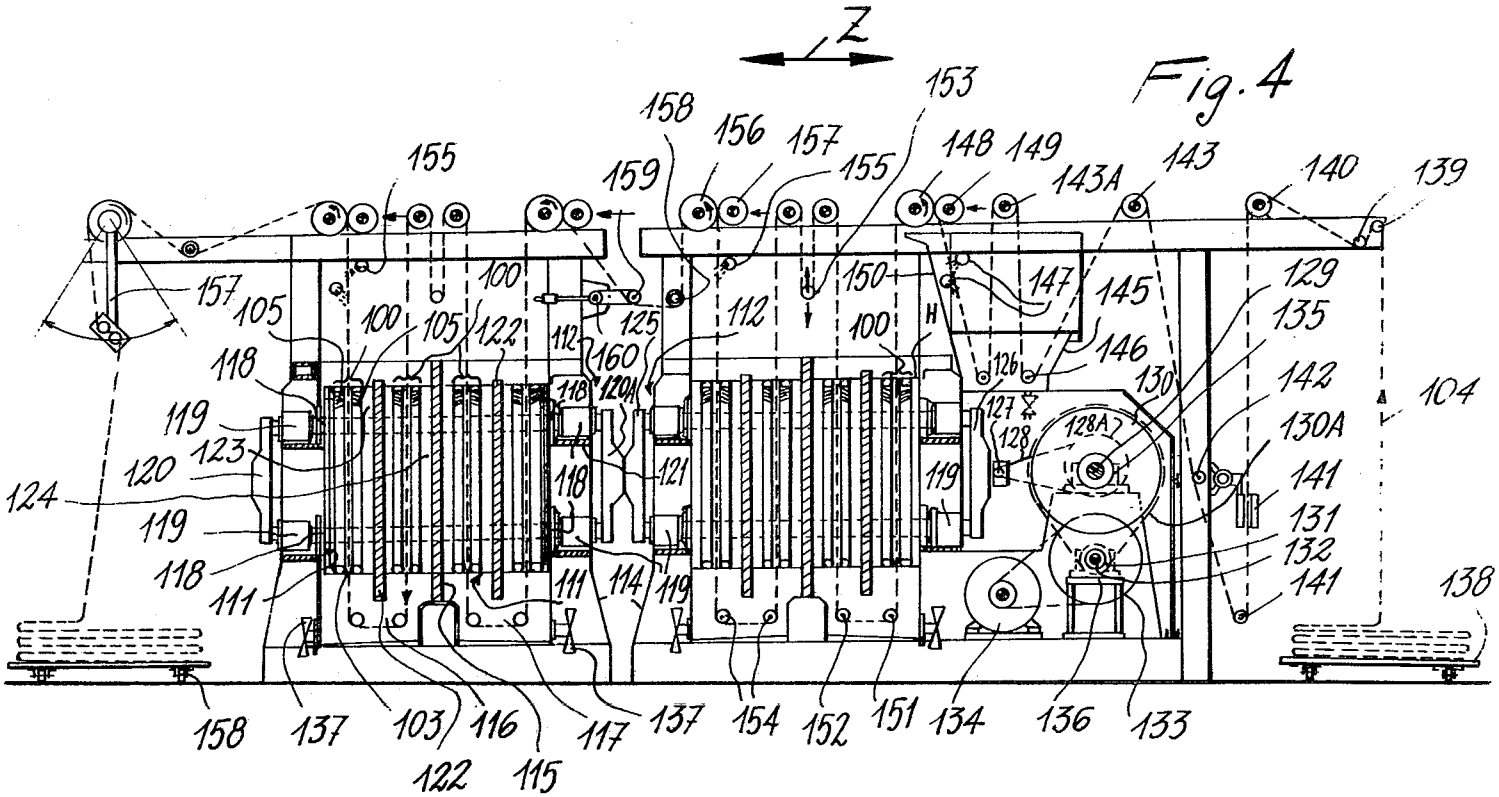
FIG. 4 is a schematic vertical sectional view showing the apparatus according to the invention.

Referring to FIG. 4, the exemplarily shown apparatus comprises a pair of containers 112 identical to each other and provided with a supporting structure 114. These containers are divided into two basins 116, 117 by an intermediate partition 115, but provided with passages for shafts 118 which are evidently in a number of four. These shafts 118 sealingly pass through (by means of stuffing boxed or resilient bellows) the walls of container 112 and are guided in ball bearings or bush-bearings 119 allowing axial motions, that is in the direction shown by arrow Z.

The four shafts 118 of each container 112 are joined to one another by means of spiders 120, 120A, 125, 126 and bearings 119 are carried by supporting structure 114 on cross pieces 121.

Each of basins 116, 117 have located therein a partition 122 (with passages for shafts 118) which, along with the end walls of container 112 and intermediate wall 115 define in each of the basins two chambers 123, 124, in each of which there is a channel 100, as above described, with the only difference that permeable walls 105 for one of channels 100 have tubular sections 107 thereof directed to provide liquid jets having a component in opposite direction to that of jets of adjoining channels. In other terms, the jets should promote the feeding direction of the fabric 104 (shown by broken lines), which fabric moves in opposite directions in passages 103 of two adjoining channels.

Container 112, at the right side of FIG. 4, is of an identical construction to that herein just described, whereby it has been still more schematically shown and will not be described, except as necessary to understand the operation.

Spider 120A is connected with spider 125 connecting shafts 118 projecting from the left side of the right-hand container 112, and the opposite spider 126 is connected through a pin 127 to a connecting rod 128 carried on a cam 128A fixed to a shaft 129, on which a large diameter pulley 130 is keyed, operating as a flywheel and driven by a belt 130A from a pulley 131, the latter being keyed to a shaft 132. This shaft 132 is driven through a belt drive 133 by an electric motor 134. As apparent, chains could be provided instead of belts and gear wheels in lieu of pulleys.

Shafts 129, 132 are carried on bearings 135, 136 supported by the apparatus base. Each of basins 116, 117 are provided with bottom discharges or outlets 137 and filled with liquid.

The fabric is treated as follows:

Folded up fabric 104, as placed on a carriage 138, passes on a pair of oscillating rollers 139 and is then downward shifted by a driving roller 140. The fabric passes through a well known fabric guide member 141, not further particularly described as not pertaining to the subject of the invention, and is then upwardly moved back again through cylinders or rollers 141 and 142. Then, through a driving roller 143, it is supplied to a basin 145, which is separated into two zones and provided with driving rollers 146 carried between the walls thereof. The fabric is here impregnated with a first liquid, such as a detergent solution, passing from one to the other zone along a driving roller 143A. At the outlet of basin 145, nozzles 147 spray from opposite sides the fabric with the same solution or liquid withdrawn from basin 145 through a pump, not shown. The fabric is then wrung between two rollers 148, 149, of which one is operated by a geared motor, not shown, and the other is resiliently pressed against the former. The liquid wrung by the rollers and sprayed by nozzles 146 flows back to basin 145 along the sloping wall 150 of the latter. The fabric passes vertically through the first permeable wall channel 100, which is given through shafts 118 a to-and-fro or oscillating movement in the direction shown by arrows Z by the above described drive means. The liquid in basin or container 112 up to level H is forced along passages 110 (depending on the direction of transverse movement imparted to the channel), falls on and passes through the fabric, causing it to move against the concave bases of the other wall.

Through driving rollers 151 and 152, located at the bottom, the fabric passes to a second permeable wall channel (where it is subjected to alternating jets of liquid) and is then piled up in a dandy roll device 153 before reaching a pair of consecutive permeable wall channels, travelling the latter with opposite directions of movement. Bottom rollers 154 provide for guiding the fabric from one to the other channel. The fabric is then wrung between a pair of rollers 156 and 157, of which one is driven by a geared motor, not shown, and the other is resiliently pressed against the former. The fabric is then shifted by a roller 158 and a rocking roller 159, pivoted at 160, which in the absence of fabric will lower, causing a stop in the operation of motor 134 by acting on electric contact members.

Similarly to the above description, the fabric passes through permeable wall channels 100 of the next subsequent basin 112 (where there may be a liquid different from the others at a level H), undergoing corresponding operations to finally arrive at a per se known folding up device 157, not further described, which folds up the fabric on an unloading carriage 158.

From the foregoing, it is apparent that the particular configuration of the permeable wall channels allows during to-and-fro movement thereof to strike the fabric passing through such channels with high speed liquid jets alternately directed in nearly opposite directions. Accordingly, the fabric simultaneously undergoes a mechanical action of flapping and slipping against the apices of concave walls 108 by means of a fraction of jet liquid and a passage and downward thrust action by means of the other fraction entering the passages 110 of the opposing wall.

Obviously, the invention is not limited to the examples herein shown and described, but extends also to the variations within the scope of the inventive concept.

As apparent, instead of the cam drive unit, use could be made of a rotary eccentric mass vibrator similar to that described in connection with FIG. 1. Such a vibrator could be supported by spider 126 through springs and guide rods. Instead of triangular sections having a concave base, V-sections could be provided with the open side facing the fabric and rounded apices.

What I claim is:

1. In an apparatus for treating fabrics, at least one pair of channel walls defining between themselves a channel adapted to be filled with liquid and adapted to have a fabric which is to be treated spread out and extending through said channel, each of said channel walls comprising a series of sections and shoulders interconnecting said sections, and each of said sections including at least a pair of section walls intersecting distant from said channel to form an apex facing away from said channel, and said section walls of each section diverging with respect to each other from said apex toward said channel to form a substantially V-shaped structure, said sections being spaced from each other along each channel wall and forming pairs of adjoining sections with each pair of adjoining sections respectively having a pair of adjoining section walls which converge toward each other from the apexes of each pair of adjoining sections toward said channel to define between each pair of adjoining sections a liquid passage the section of which decreases from said apexes toward said channel, whereby said channel walls are permeable to liquid capable of travelling through said liquid passages toward said channel, and means connected to said channel walls for transversely oscillating said channel walls in the general direction of said liquid passages to provide a high speed for liquid travelling through said liquid passages toward said channel, and said sections of each channel wall being inclined with respect to said channel for providing from the liquid issuing from between each pair of adjoining sections into said channel a component of movement tending to advance the fabric in the channel in a given direction.

2. The combination of claim 1 and wherein said section walls of each section respectively terminate in inner edges distant from said apex of each section, and said inner edges being rounded to avoid injury to fabric travelling along said channel.

3. The combination of claim 2 and wherein each section includes an inner wall extending between and interconnecting said rounded inner edges for providing each section at least substantially with the configuration of a triangle the base of which is formed by said inner wall.

4. The combination of claim 3 and wherein said inner base walls of said sections respectively have concave surfaces directed toward said channel.

5. The combination of claim 4 and wherein the concave bases of the sections of one of said channel walls are respectively offset with respect to the concave bases of the sections of the other of said channel walls.

6. The combination of claim 5 and wherein said inner edges of said section walls define outlets through which liquid travels from said liquid passages into said channel, and the concave bases of the sections of one of said channel walls being situated substantially in alignment with the outlets between the sections of the other of said channel walls so that liquid issuing through said outlets of one channel wall urges the fabric toward the concave bases of the sections of the other of said channel walls.

7. The combination of claim 6 and wherein each section has flat section walls connected at its inner edges to the concave base wall of each section.

8. The combination of claim 1 and wherein said section walls are flat.

* * * * *